United States Patent [19]

Styles

[11] Patent Number: 4,923,258

[45] **Date of Patent: * May 8, 1990**

[54] MOISTURIZED REFRIGERATED PRODUCE RACK COVERED BY MULTIPLE CURTAINS AND STRIP CONNECTORS

[76] Inventor: J. Cabot Styles, 162 Paradise Cove, Malibu, Calif. 90265

[ * ] Notice: The portion of the term of this patent subsequent to Jan. 31, 2006 has been disclaimed.

[21] Appl. No.: 303,844

[22] Filed: Jan. 30, 1989

Related U.S. Application Data

[63] Continuation-in-part of Ser. No. 533,413, Sep. 19, 1983, abandoned, and a continuation-in-part of Ser. No. 809,564, Dec. 16, 1985, abandoned, and a continuation-in-part of Ser. No. 917,424, Oct. 10, 1986, Pat. No. 4,801,180.

[51] Int. Cl.[5] ..... A47F 3/04

[52] U.S. Cl. ..... 312/115; 312/116; 160/241; 160/354

[58] Field of Search ..... 312/115, 296, 116, 138 R; 211/127; 180/241, 354, 290 R, 23 R, 120; 239/146; 220/306

[56] References Cited

U.S. PATENT DOCUMENTS

| | | | |
|---|---|---|---|
| 431,509 | 7/1980 | Dernell | 312/115 |
| 2,127,379 | 8/1938 | Adams | 312/291 |
| 2,305,435 | 12/1942 | McAfee | 211/127 |
| 2,492,695 | 12/1949 | Henderson | 312/116 X |
| 2,518,134 | 8/1950 | Fredenhagen et al. | 312/116 X |
| 2,625,806 | 1/1953 | Kennedy | 312/115 X |
| 2,929,227 | 3/1960 | Rainwater | 312/116 X |
| 3,020,113 | 2/1962 | Molitor | 312/284 |
| 3,146,824 | 9/1964 | Veilleux | 160/23 R |
| 3,542,445 | 11/1970 | Donter | 312/116 |
| 3,941,275 | 3/1976 | Simmons | 220/306 |
| 4,109,484 | 8/1978 | Cunningham | 160/354 X |
| 4,117,698 | 10/1978 | Vogel | 312/116 X |
| 4,186,790 | 2/1980 | Schenker et al. | 312/116 X |
| 4,288,992 | 9/1981 | Eliason | 312/116 X |
| 4,296,792 | 10/1981 | Gidge et al. | 312/116 X |
| 4,312,396 | 1/1982 | McKinnon et al. | 160/332 |
| 4,392,360 | 7/1983 | Gidge et al. | 312/116 X |
| 4,419,982 | 12/1983 | Eckels | 160/120 X |
| 4,458,501 | 7/1984 | Kooy | 312/116 X |
| 4,801,180 | 1/1989 | Styles | 312/115 |

FOREIGN PATENT DOCUMENTS

| | | | |
|---|---|---|---|
| 505729 | 9/1954 | Canada | 211/127 |
| 2847399 | 5/1980 | Fed. Rep. of Germany | 312/284 |
| 1281067 | 11/1961 | France | 312/296 |
| 646856 | 11/1950 | United Kingdom | 211/127 |
| A2096222 | 10/1987 | United Kingdom | 160/120 |

*Primary Examiner*—Joseph Falk
*Attorney, Agent, or Firm*—Timothy T. Tyson

[57] ABSTRACT

A produce rack for the display and storage of produce having a display surface and an opening allowing the produce to be viewed. Refrigerated air is provided to the produce through the display surface. Water is periodically sprayed onto the produce by an automatic watering system. A flexible cover selectively closes the opening to optimize the condition of the air inside the display area. The cover includes a plurality of transparent curtains that roll up on rollers for storage and roll down for use. Strip connectors close the gaps between adjacent curtains. Hook and loop fasteners on the edges of the curtains and connectors allow the connectors to be secured to the curtains across the gaps simply by placing the connectors across the gaps.

3 Claims, 5 Drawing Sheets

MOISTURIZED REFRIGERATED PRODUCE RACK COVERED BY MULTIPLE CURTAINS AND STRIP CONNECTORS

RELATED APPLICATIONS

This application is a continuation-in-part of applicant's previously filed applications Ser. No. 06/533,413, filed Sept. 19, 1983, now abandoned, Ser. No. 06/809,564, filed Dec. 16, 1985, now abandoned, and Ser. No. 06/617,424, filed Oct. 10, 1986, now U.S. Pat. No. 4,801,180, issued Jan. 31, 1989.

BACKGROUND OF THE INVENTION

1. Field of the Invention

The present invention pertains to the refrigerated produce rack art, and more particularly, to a moisturized rack having a cover.

2. Background Art

Produce for sale in supermarkets that is subject to rapid spoilage is typically displayed in an open refrigerated produce rack. The display surface for the produce rack is elevated to a convenient height for viewing by the consumer. Piles of produce are placed on the display surface. The rear of the display surface is usually slightly elevated allowing the consumer to see both the front and back of the piles. Cold air produced by the refrigeration equipment flows up through the display surface cooling the produce positioned thereon.

Spoilage of produce is caused by several factors: oxidation, bruising, fungal and bacterial growth, and wilting. The cold air cools the produce thereby reducing the rate of oxidation, the ability of fungi and bacteria to grow, and the rate at which water evaporates.

Water is usually sprayed periodically onto the produce from a hose by an employee. The water replaces water that has previously evaporated from the surface of the produce. The renewal of the water on the surface of the produce serves two functions: to avoid the drawing of water from inside the produce and the concomitant wilting, and to further cool the produce by drawing heat energy from the produce during the evaporation process.

At the close of the business day, an employee may have to spend several hours breaking down the produce rack by removing all or a portion of the produce from the rack, packing and wetting the produce, cleaning the produce rack, and storing the produce in a refrigerated area. Prior to the opening of the store, an employee must set up the produce rack by bringing the stored produce from the regrigerated area, unpacking and placing the produce into the produce rack, culling any spoiled produce, and watering the displayed produce. During the business day, an employee must monitor the produce rack to cull spoiled produce and periodically water the produce. Inherent in the present method is the problem of increased spoilage due to the mechanical handling of the produce during the different steps leading to bruising and cross contamination by fungi and bacteria from other produce.

Numerous U.S. patents have been issued for various types of conditioned air display cases and accessories for stores, for example: 431,509 to Dernell; 2,305,435 to McAfee; 2,492,695 to Henderson; 2,518,134 to Fredenhagen et al.; 2,625,806 to Kennedy; 3,542,445 to Donker; 4,109,484 to Cunningham; 4,117,698 to Vogel; 4,186,790 to Schenker et al.; 4,288,992 to Eliason; 4,296,792 to Gidge et al; 4,312,396 to McKinnon et al.; and 4,392,360 to Gidge et al.

Dernell, McAfee and Kennedy are specifically for the display of vegetables and have water sprayers to provide moisture. McAfee and Kennedy have sloping display areas and electric time switches to spray the produce with water automatically.

In order to keep the conditioned air inside the display cases, barriers are sometimes provided to retain the conditioned air inside the cases. Door type barriers having transparent windows are disclosed in the above identified patents to Dernell, Henderson, and Fredenhagen et al. allowing the customer to identify a desired item inside through the windows and then open the doors to retrieve the item. Flexible sheet type barriers that are not transparent are disclosed in Donker, Eliason, Cunningham, Marshall, and Eliason primarily for use during hours when the store is closed. Schenker, Eliason, Gidge et al. (both), and McKinnon et al. disclose flexible transparent strip curtains that allow the customer to see the merchandise and reach between two strips to retrieve a desired item. All of the flexible covers are for substantially vertical display cabinets with multiple shelves. None of the prior art display cases having sloped display areas primarily for vegetables have covers of any kind.

SUMMARY OF THE INVENTION

The present invention is directed to a moisturized refrigerated produce rack for the display and storage of produce. A flexible cover means selectively closes the opening into the display area thereby optimizing the air conditions inside the display area for a significant portion of the day such as at night.

In accordance with one important aspect of the invention, the produce rack has a display area with a display surface for supporting the produce and an opening for viewing the produce A means is provided for introducing refrigerated air through the display surface into the display area. Spray heads in the display area water the produce periodically according to an automatic control means. Fasteners between the cover means edges and the opening allow the cover to be readily opened and closed as desired The cover means has at least two adjacent curtains in the same plane and a strip connector between the adjacent curtains. The curtains are extended over the opening and secured to the edges. The connector is then place between the curtains. A roller is provided for each of the curtains for rolling up the curtains when not needed to close the opening into the display area.

In a preferred embodiment, fasteners are provided on the curtain and connector edges. The fasteners are of the type having hook and loop portions allowing the strip connector to be secured to the curtains by simply laying the connector edges on the curtain edges.

DESCRIPTION OF THE PREFERRED EMBODIMENTS

Figure 1:
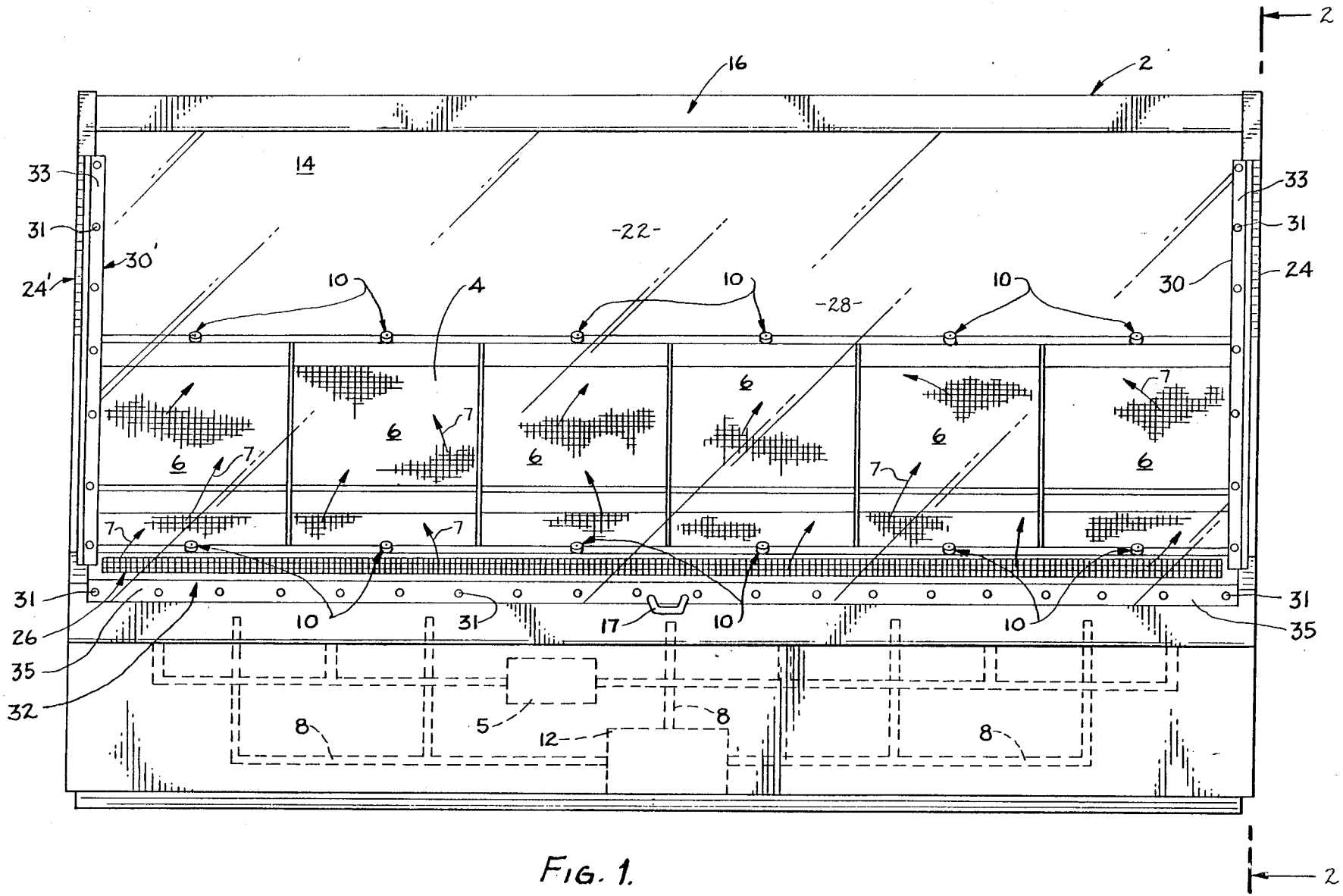
FIG. 1 is a front elevational view of a produce rack having an automatic watering system and a roll-type cover member for extending over the produce on the display surface.

Referring initially to FIG. 1, there is illustrated a produce rack, generally designated 2, for the continuous refrigerated display and storage of produce. The produce rack 2 has a display area 4 slanted toward the viewer with display surfaces 6 for the display of produce. The produce is stacked on the display surfaces 6 in mounds for sale. The produce rack 2 is designed to allow the produce to remain on the display surfaces 6 indefinitely without the usual requirement for breaking down and setting up the produce rack as with traditional racks. Significant time, labor expense, and mechanical damage to the produce are thereby avoided. Emperical evidence has indicated that produce stored and displayed in the produce rack 2 has a shelf life between 67% and 250% greater, depending upon the type of produce, than the shelf life of produce on a standard produce rack.

The display surfaces 6 are grills providing outlet vents for a refrigeration system located inside the produce rack 2 and having a compressor, fan, and ductwork system 5 represented in shadow outline. The refrigeration system draws air into an intake, cools the air, and exhausts the cold air up through the display surfaces 6. The cold air then circulates around the mounds of produce on the display surfaces 6 as indicated by the arrows 7 thereby cooling the produce below the ambient room temperature.

An automatic watering system 8, also represented in shadow outline, is located inside the produce rack 2 and has a plurality of spray heads 10. The watering system 8 substantially eliminates the requirement for having an employee periodically spray the produce. Each spray head 10 preferrably has a valve for turning off the head whenever it is not needed. The spray heads 10 selectively spray water over the display area 4 from the front and rear as better seen in FIG. 2.

Figure 2:
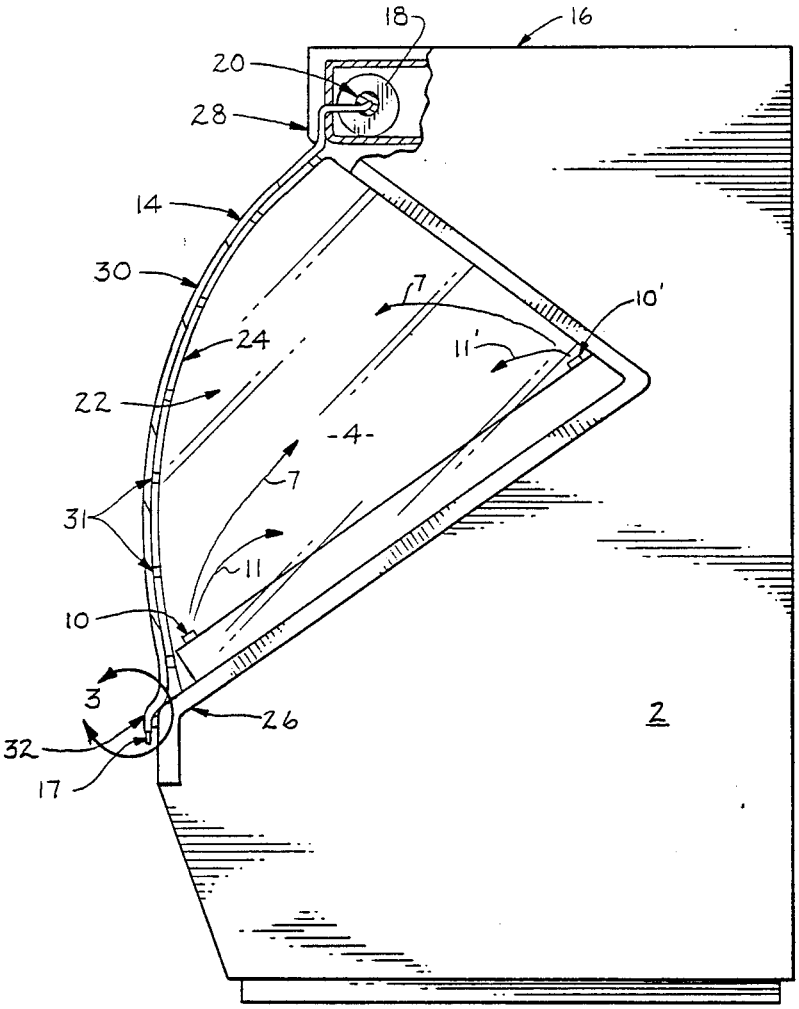
FIG. 2 is a side elevational view with a partial sectional view along the line 2—2 of FIG. 1.

FIG. 2 is a side elevational view of the produce rack 2. Each spray head 10 provides a fine mist spray over a relatively short distance as represented by the arrows 11. Thus, the front spray head 10 produces a fine mist spray emanating from the head 10 as represented by the arrow 11. The rear spray head 10′ produces a fine mist spray emanating from the head 10′ as represented by the arrow 11′. The cold air circulated by the refrigeration system and represented by the arrows 7 contributes to the spreading of the fine mist spray by wafting the spray to every portion of the display area 4.

Avoidance of wetting the area in front of the produce rack 2 (to the left in FIG. 2) is highly desirable in order to avoid wetting customers and the floor. The short range of the rear head 10′ assures that the spray from the rear head does not reach the front wall 26 and the front head 10 sprays toward the rear wall 28 away from the front.

Returning to FIG. 1, an automatic watering control means 12 is provided for the operation of the sprinkler heads 10. The watering control means 12 has an electrical timer control that operates one or more solenoid valves. The control means 12 is preferably programmable allowing the operation of the sprinkler heads 10 to be predetermined and modified according to the time of day, intervals, and sequences. Optimal spraying may thereby be achieved with variations along the length of the rack 2 according to the different requirements of various vegetables and time of day. Programmed spraying also continues through the night when no employees are present.

One advantage of sequential spraying is the automatic warning of customers. For example, one sprinkler head 10 may be slowly opened and operated at one end of the produce rack 2 thereby warning customers away from the immediate area. The next sprinkler head 10 or group of heads may then be started with the first head stopped or maintained in operation as desired thereby warning customers away from the second area. The automatic watering control means 12 shifts the portion of the display area 4 being watered sequentially down the rack 2 thereby warning and creating a minimum of disruption for customers.

A cover member 14 may be selectively extended from a rolled position in the upper portion 16 of the produce rack 2 to the front wall 26 by means of a handle 17. The cover member 14 is fabricated of a transparent flexible plastic material. As shown in FIG. 2, the upper edge 20 of the cover member 14 is attached to a holding and releasing means in the form of a spring loaded roller 18 similar to a window shade roller. When the spring means inside the roller 18 is released, the roller returns the cover member 14 to a rolled up position on the roller 18 above the display area 4.

As seen in FIG. 1, the cover member 14 is slightly larger in size than the opening 22 surrounding the display area 4. The opening 22 is defined by a right side wall 24, the front wall 26, a left side wall 24′, and the rear wall 28. When the cover member 14 is unrolled, the right side edge 30, front edge 32, and left side edge 30′ overlap the right side wall 24, front wall 26, and left side wall 24′, respectively, to retain the conditioned air inside the display area 4. When the cover member 14 is extended during the period when the store is closed such as at night, significant economies of operation are achieved including lower refrigeration costs to cool the air inside the display area 4, lower heating costs to warm the air outside the produce rack 2, lower water costs due to less evaporation of water from the produce, and lower spoilage of produce due to the superior control of the environment immediately surrounding the produce.

The cover member 14 is secured around the opening 22 by a plurality of snaps 31. A portion of each snap 31 is located on the cover member 14 through reinforcing strips 33 along the edges 30 and 30′ or through a handle strip 35 along the front edge 32. Cooperating portions of the snaps 31 are located on the edges of the walls 24, 24′, or 26. The snaps 31 are used by unrolling the cover member 14 into position over the opening 22 and then pushing the cooperating portions of the snaps 31 together. The snaps 31 keep the cover member 14 unrolled and in place over the opening 22. Where the produce rack 2 has an outwardly curved side wall 24 as shown in FIG. 2, the snaps 31 retain the edge 30 of the cover member 14 on the outer curvature of the wall 24. Without the snaps 31, the cover member 14 might sag toward the middle of the produce rack 2 drooping down inside the wall 24 leaving a large air gap between the edge 30 of the cover member and the wall. Miminization of air flow around the edges of the cover member 14 is desirable in order to avoid the introduction of extraneous heating, cooling, and moisture factors into the conditioned air system provided inside the produce rack 2 when the cover member 14 is closed.

Figure 3:
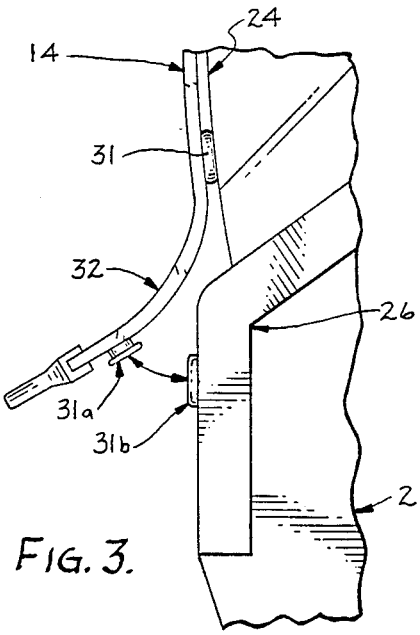
FIG. 3 is an enlarged partial side elevational view along the line 3—3 of FIG. 2 showing snaps for securing the cover member.

FIG. 3 is an enlarged partial side elevational view along the line 3—3 of FIG. 2 showing a detail of the use of the snaps 31 to secure the cover member 14 to the walls 24 and 26 of the produce rack 2. Each snap 31 has an insert portion 31*a* and a socket portion 31*b*. The snap 31 is secured by pushing the insert portion 31*a* into the socket portion 31*b*. The snap is opened by pulling the insert portion 31*a* out of the socket portion 31*b*.

Figure 4:
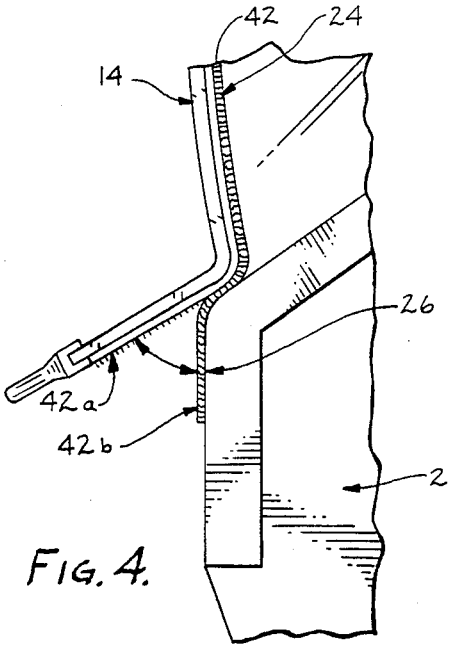
FIG. 4 is an enlarged partial side elevational view similar to FIG. 3 showing hook and loop fastener strips for securing the cover member.

FIG. 4 is an enlarged partial side elevational view similar to FIG. 3 showing hook and loop strip fasteners 42 such as those sold under the trademark VELCRO as an alternative perferred means of securing the cover member 14 to the walls 24 and 26 of the produce rack 2. Unlike the case in FIG. 3 where exact extension of the cover member 14 from the roller 18 (FIG. 2) is required to position the snaps 31 for closing, exact extension is not required when the Velcro type fasteners 42 are used. All that is required is that the hook portion 42*a* be pushed into the loop portion 42*b*.

The hook and loop fasteners 42 have the additional advantage of minimizing the space and consequent flow of air between the cover member 14 and the side wall 24 and front wall 26. The movement of ambient air from outside the produce rack 2 into the display area 4 and the movement of conditioned air from inside the display area to the outside is thereby avoided.

Figure 5:
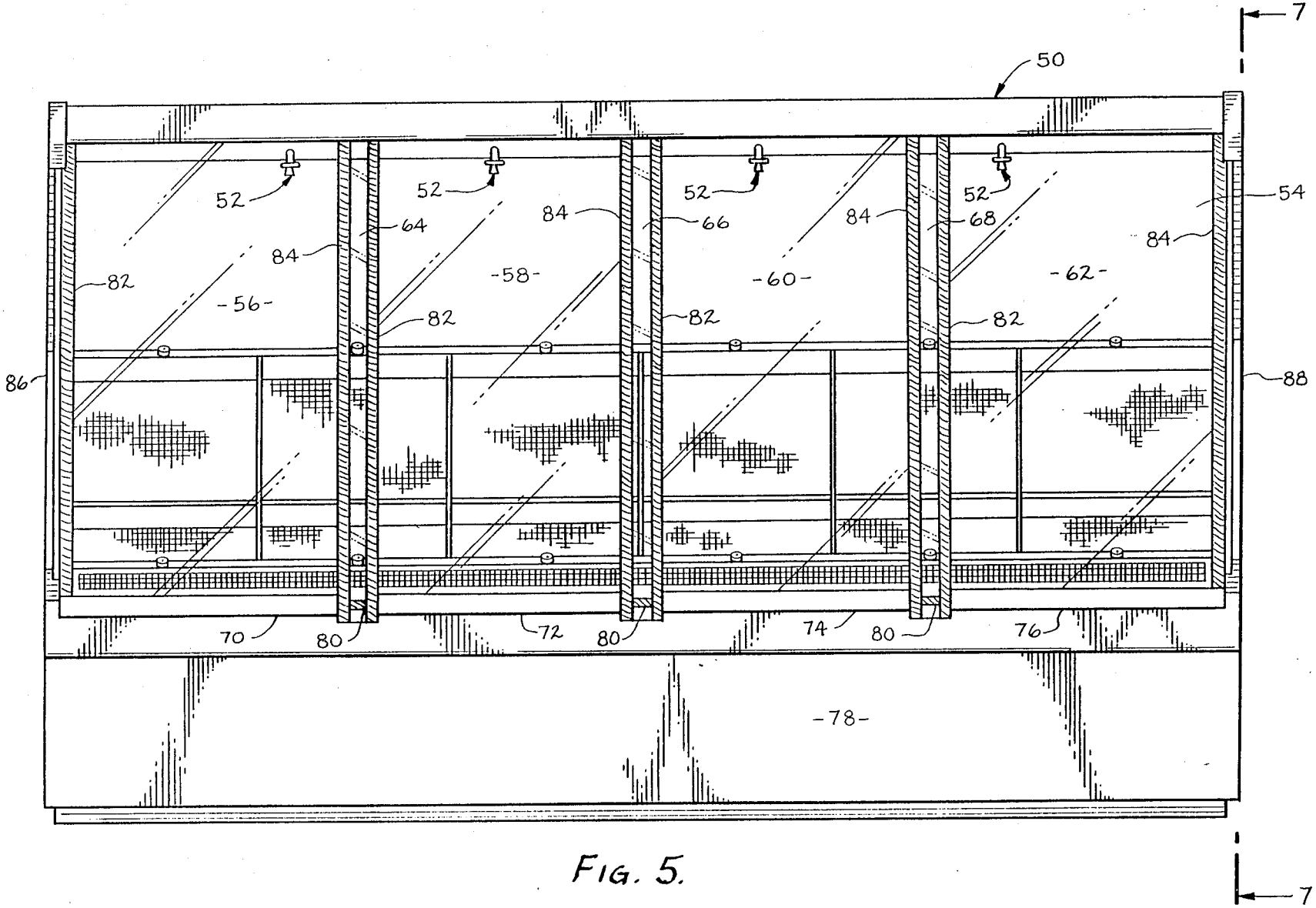
FIG. 5 is a front elevational view of a produce rack having an automatic watering system and cover member in accordance with the present invention.

FIG. 5 is a front elevational view of a produce rack and cover member, generally designated 50, of the present invention similar to FIG. 1. The refrigeration and watering systems of the produce rack 50 are substantially the same as the systems in the produce rack 2 of FIG. 1 with the addition of upper spray heads 52. The cover member 54, however, is divided into a plurality of curtains 56, 58, 60, and 62 and means for covering the gaps between the curtains in the form of strip connectors 64, 66, and 68. Each curtain may be raised and lowered independently in the same manner as the cover member 14 of the produce rack 2. The division of the cover member 54 on the produce rack 50 facilitates the opening and closing of the cover member.

The bottom edges 70, 72, 74, and 76 of the curtains 56, 58, 60, and 62 are secured to the front wall 78 of the produce rack 50 by the use of a fastener means such as hook and loop strip fasteners 80. The fasteners 80 are similar to the strip fasteners 42 illustrated in FIG. 4. A portion of the strip fasteners 80 is coupled under the bottom edges 70, 72, 74, and 76 of each curtain for engagement with a cooperating strip fastener portion coupled to the front wall 78. Each curtain also has a portion of a strip fastener 82 along the left edge and another portion 84 along the right edge. The left edge of the curtain 56 and the right edge of the curtain 62 are attached to the left and right side walls 86 and 88 of the produce rack 50 in the same manner as the cover member 14 is attached to the side wall 24 as shown in FIG. 4.

After the bottom edges 70, 72, 74, and 76 are secured to the front wall 78 and the outer edges of the curtains 56 and 58 are secured to left and right side walls 86 and 88, respectively, gaps still remain between curtains 56 and 58, curtains 58 and 60, and curtains 60 and 62. These gaps are covered by the strip connectors 64, 66, and 68, respectively.

Figure 6:
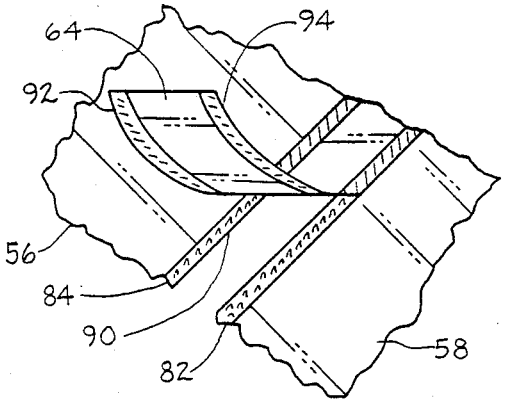
FIG. 6 is an enlarged perspective view of a connector strip mounted between two curtains.

FIG. 6 is an enlarged perspective view of the strip connector 64 being mounted over the gap 90 between the two curtains 56 and 58. FIG. 6 is also representative of the use of the strip connectors 66 and 68 to close the gaps between the curtains 58 and 60 and 60 and 62, respectively. The strip connector 64 is fabricated of a transparent plastic material identical or similar to the transparent plastic material used to fabricate the curtains 56 and 58. The strip connector 64 is retained in position over the gap 90 by portions of strip fasteners 92 and 94 complementing the portions 84 and 82 on the curtains 56 and 58. After the curtains 56 and 58 are secured to the front wall 78 as shown in FIG. 5, the gap 90 is closed by laying the connector strip 64 onto the curtains 56 and 58 as shown in FIG. 6 with the strip fastener 84 engaging the strip fastener 92 and the strip fastener 82 engaging the strip fastener 94. The placement of the other strip connectors 66 and 68 between the curtains 58, 60, and 62 completes the sealing of the cover member 54 onto the produce rack 50. The gap 90 and the other gaps are then effectively closed providing a sealing means between the conditioned air inside the produce rack 50 and the ambient air outside.

The strip curtains disclosed in Schenker, Eliason, Gidge et al. (both), and McKinnon et al. discussed above are significantly narrower than the curtains 56, 58, 60, and 62 of the present invention. In addition, they are hung vertically with no connectors between individual strips thereby allowing easy movement in any side direction. The physical presence of the individual strips partially blocks the flow of air in and out of the cabinets. Some further improvement in the blockage of air flow is achieved by having the strips overlap as in Schenker, Gidge '792, and McKinnon. However, significant volumes of air may pass through any crack or opening. Eliason utilizes a different method by providing wide sheets to complement the strips to reduce the number of openings through which air may flow. But no sealing connectors are present between the individual sheets in Eliason thereby allowing significant leakage to continue.

Figure 7:
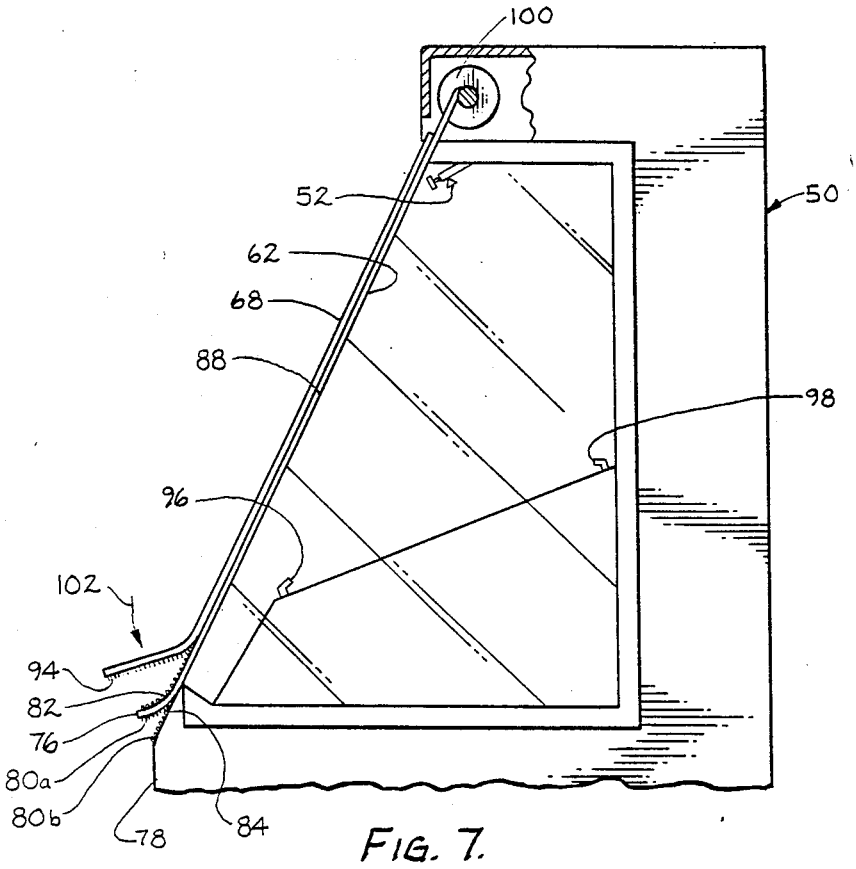
FIG. 7 is a partial side elevational view along the line 7—7 of FIG. 5.

FIG. 7 is a partial side elevational view of the produce rack 50 of the present invention along the line 7—7 of FIG. 5. The upper spray head 52 complements the spray pattern of the front spray head 96 and rear spray head 98 which are substantially similar to the spray patterns of the heads 10 and 10' in FIG. 2. The right side wall 88 has a flat outer edge in contrast to the curved outer edge of the the side wall 24 in FIG. 2 in order to facilitate the extension of the curtain 62 from the spring biased roller 100 down to the front wall 78. The front edge 76 of the curtain 62 is secured to the front wall 78 by pressing the strip fastener portion 80*a* on the curtain onto the strip fastener portion 80*b* on the front wall. The curtain 62 remains taut between the roller 100 and the front wall 78 due to the action of the spring inside the roller. The right side of the curtain 62 is attached to the right side wall 88 by the strip fastener 84. After the curtain 62 is secured, the strip connector 68 is placed over the gap between the curtain 62 and the adjacent curtain and the gap is closed by pressing the strip fastener portion 94 on the connector into the strip fastener portion 82 on the curtain in the direction of the arrow 102 as described above in conjunction with FIG. 6.

Figure 8:
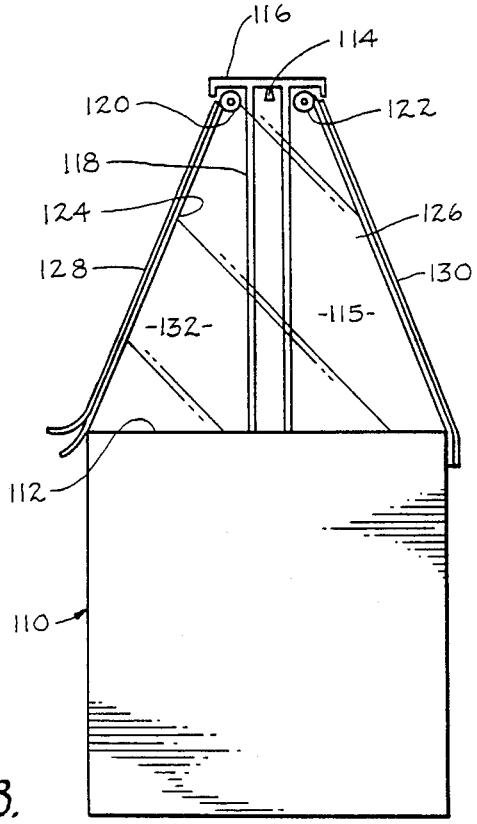
FIG. 8 is an end elevational view of another embodiment of the present invention.

FIG. 8 is an end elevational view of another embodiment, generally designated 110, of a produce rack of the present invention. The previous produce racks 2 and 50 described above are designed to fit against a wall. The produce rack 110 is an island type rack designed to stand alone in the middle of a store. A refrigeration system and watering system substantially similar to the systems in the previous embodiments cools and waters produce located on a display surface 112. A spray head 114 provides an overhead watering feature. Enclosure of the display surface 112 in accordance with the structure and method of the present invention is partially achieved by placing a transparent wall 115 at the near end of the rack 110 and a similar wall at the other end. A top shelf 116 rising on supports 118 provides a means for mounting a plurality of spring biased rollers 120 and 122 along each side of the produce rack 110. Each roller holds and selectively stores a curtain 124 and 126. A produce rack 110 having a length equal to the length of the produce rack 50 illustrated in FIG. 5 might therefore conveniently have four curtains on each side of the shelf 116 and the display surface 112 for a total of eight curtains. Strip connectors 128 and 130 identical to the strip connectors 64, 66, and 68 are utilized to close any longitudinal gaps between the curtains in the same manner as describe above in conjunction with FIGS. 5 through 7 to cover a display area 132 above the display surface 112.

Figure 9:
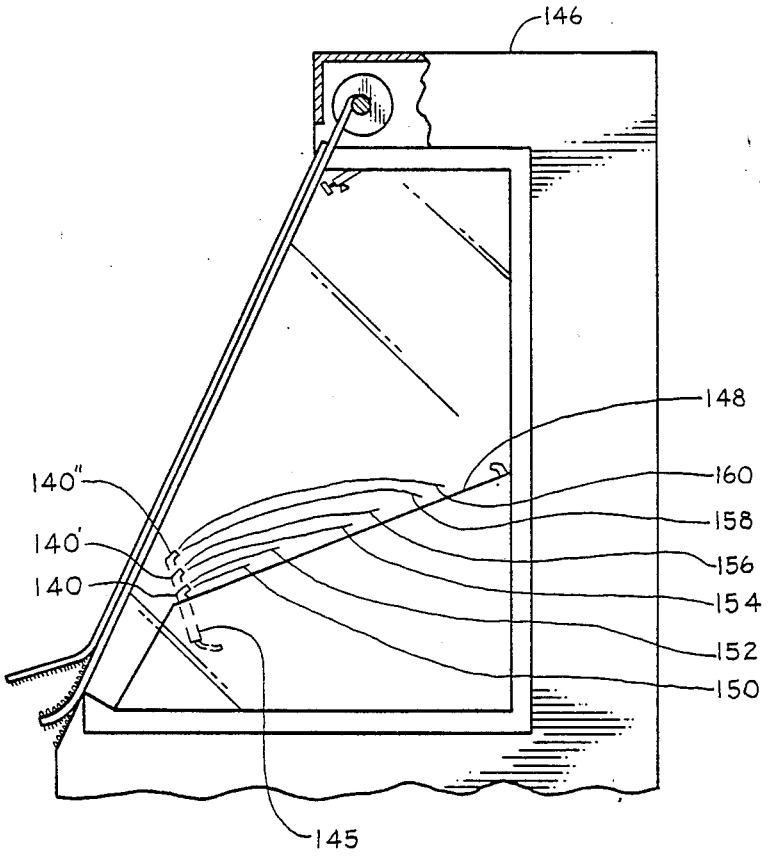
FIG. 9 is a view similar to FIG. 7 showing alternative pop-up spray heads.

FIG. 9 is a view similar to FIG. 7 showing alternative pop-up spray heads 140. As shown in FIG. 9 only the front spray heads pop-up. The rear spray heads 142 remain stationary but could be made to pop-up if desirable. The upper spray head 144 also remains stationary. The front spray heads 140 operate in a manner well known in the art, i.e they are pulled down by gravity to a rest position when they are not spraying water and are forced up by water pressure to raised positions 140' or 140'' when spraying water. The height of the raised position is determined by the length of the cylinder 145 inside the head. It is particularly advantageous to have pop-up front spray heads in a produce rack 146 having a sloped display area 148 such as shown in FIG. 9. The heads 140 are then normally out of the way allowing unobstructed access to the display area. Only when spraying is actually occuring do they rise up to more effectively cover the display area with water. Thus, as shown in FIG. 9, in the lowest rest position 140, spray 150 and 152 only reaches about half of the display area. In the middle position 140', the increased elevation allows the spray 154 and 156 to reach about three-fourths of the display area. In the highest position 140'', the elevation allows the spray 158 and 160 to reach substantially all of the display area.

In view of the above, it may be seen that an automatic moisturized refrigerated produce rack for the display and storage of produce is provided. Of course, the structure and method may be variously implemented, performed, and used depending upon specific applications. Accordingly, the scope hereof shall not be referenced to the disclosed embodiments, but on the contrary, shall be determined in accordance with the claims as set forth below.

I claim:

1. A produce rack for storing and displaying produce, comprising:

a display area having a display surface for supporting said produce and defining an opening for viewing said produce;

said display area opening having a rear wall, a front edge, a right side wall, and a left side wall;

means for providing refrigerated air through said display surface into said display area;

means for watering said produce having spray heads in said display area;

control means for automatically controlling said means for watering; and flexible cover means for selectively closing said opening having:

at least two curtains, each of said curtains having a left edge, a right edge, and a spring-loaded roller coupled to said rear wall;

said curtains selectively extending to said front edge; and said rollers rolling up said curtains for storage when said curtains are not extended over said opening to said front edge;

said left edge of one of said at least two curtains spaced from and substantially parallel to said right edge of an adjacent of said at least two curtains defining a substantially rectangular gap therebetween;

one strip connector for each of said gaps for covering said gap when said adjacent curtains are extended over said opening; and fastener means for securing said strip connector to said adjacent curtains.

2. A produce rack according to claim 1 wherein a portion of said spray heads pop-up from rest positions when not spraying water to raised positions when spraying water.

3. A produce rack according to claim 1 wherein said fastener means includes a hook portion and a loop portion.

* * * * *